United States Patent [19]

Bachman et al.

[11] Patent Number: 4,736,683

[45] Date of Patent: Apr. 12, 1988

[54] DRY AMMONIUM NITRATE BLASTING AGENTS

[75] Inventors: Harold E. Bachman, Summit, N.J.; Ralph S. Totman, Ft. Saskatchewan, Canada

[73] Assignee: Exxon Chemical Patents Inc., Linden, N.J.

[21] Appl. No.: 893,406

[22] Filed: Aug. 5, 1986

[51] Int. Cl.[4] ..... C06D 5/06

[52] U.S. Cl. ..... 102/290; 102/292; 149/19.9; 149/60

[58] Field of Search ..... 149/2, 19.9, 46, 60; 102/283, 290, 292

[56] References Cited

U.S. PATENT DOCUMENTS

| | | | |
|---|---|---|---|
| 2,537,039 | 1/1951 | Downard | 52/1 |
| 2,541,389 | 2/1951 | Taylor | 52/5 |
| 3,004,842 | 10/1961 | Rowlinson | 52/14 |
| 3,052,578 | 9/1962 | Davis et al. | 149/60 |
| 3,160,536 | 12/1964 | Atchison | 149/8 |
| 3,161,551 | 12/1964 | Egly et al. | 149/46 |
| 3,164,503 | 1/1965 | Gehrig | 149/18 |
| 3,287,189 | 11/1986 | Wilson et al. | 149/8 |
| 3,447,978 | 6/1969 | Bluhm | 149/2 |
| 3,540,953 | 11/1970 | Schulze et al. | 149/2 |
| 3,764,421 | 10/1973 | Clark | 149/46 |
| 3,779,821 | 12/1973 | Fujiki et al. | 149/7 |
| 3,919,016 | 11/1975 | Dubrow | 149/60 |
| 3,959,044 | 5/1976 | Young | 149/46 X |
| 4,278,480 | 7/1981 | Johannes | 149/2 |
| 4,548,660 | 10/1985 | Ikeda et al. | 149/46 X |
| 4,615,751 | 10/1986 | Smith et al. | 149/46 X |

FOREIGN PATENT DOCUMENTS 1124604 of 1978 Japan .

OTHER PUBLICATIONS

N. C. Kozhaeva, et al., *Neftepererabotka i Neftekhimiya* (Moscow) No. 6, pp. 25,26 (1982).

G. B. Clark, "Basic Properties of Ammonium Nitrate Fuel Oil Explosives (ANFO)", *Colorado Shcool Mines Quarterly,* vol. 76, No. 1, pp. 1-32 (1/81).

G. B. Clark et al., "Performance Parameters of Micro--Prilled Ammonium Nitrate-Fuel Blasting Agents", *International Symposium Mine Research* (Univ. of Mo., Rolla, Mo.).

R. J. Grubb, "Some Factors Influencing the Explosive Properties of Ammonium Nitrate-Fuel Mixtures", *International Symposium Mining Research* (University of Minnesota, Rolla, Mo.; 1961).

K. Hino et al., "Ammonium Nitrate-Fuel Surfactant Explosives" *International Symposium Mining Research* (Univ. of Mo.; Rolla, Mo., 1961).

*Primary Examiner*—Peter A. Nelson

*Attorney, Agent, or Firm*—J. B. Murray, Jr.

[57] ABSTRACT

The invention relates generally to explosives, and more particularly to dry ammonium nitrate-fuel oil based explosives, containing a high molecular weight polymer characterized by a high stringiness factor.

37 Claims, No Drawings

DRY AMMONIUM NITRATE BLASTING AGENTS

DESCRIPTION OF THE PRIOR ART

Ammonium nitrate-containing explosives are manufactured and used widely in large volumes. Ammonium nitrate is a relatively strong oxidizing agent. However, it is not readily detonated, and it is therefore generally admixed with various fuels, modifiers and sensitizers which themselves are either explosive or non-explosive. These ammonium nitrate-containing explosives may be divided into four general types: dry blasting agents; slurry or gel explosives; emulsion (and emulsion blend) explosives; and nitroglycerin-based explosives.

In nitroglycerin-based explosives, also termed "ammonium dynamites", ammonium nitrate is used in varying amounts to replace a portion of the nitroglycerin as the explosive ingredient. These explosives are generally packaged, for example in conventional dynamite tubes, prior to use with blasting caps to initiate the explosion.

Slurry or gel explosives generally comprise a mobile or flowable mass and contain water which provides a continuous medium for the travel of the shock wave through the explosive and also generally contains water soluble thickening agents such as guar gum which are hydrogenated or cross-linked to give a gelatinous character to the final explosive. Such slurry or gel explosives are either then pumped or poured into a predrilled bore hole or packaged in sausage-like casings which are placed into such bore holes for detonation by conventional blasting caps or other means.

Emulsion explosives are generally one of two types, oil-in-water or water-in-oil emulsions. The water-in-oil explosives are more typical, although they are represented by complex chemistry in which an inverted emulsion is employed.

The dry blasting agents include so called ANFO, comprising mixtures of Ammonium Nitrate and Fuel Oil. These explosives are widely used because of their comparably lower cost, and desirably comprise free flowing particles which can be readily poured, augered or pneumatically loaded into bore holes, or into containers prior to use. ANFO explosives, in contrast to emulsion and slurry explosives, are substantially free of water. ANFO explosives have been the subject of considerable studies and the basic properties of ANFO have been widely published. See, e.g., George B. Clark, "Basic Properties of Ammonium Nitrate Fuel Oil Explosives (ANFO)," *Colorado School Mines Qtrly,* Vol. 76, No. 1, pp 1–32 (Jan. 1981). A wide variety of physical and chemical properties of ammonium nitrate have been studied (such as its particle porosity, particle density, particle size and particle shape). It has been reported, for example, that dense, microprilled ammonium nitrate has greater bulk density and (when mixed with fuel oil) a higher detonation velocity than regular porous, low density ammonium nitrate. George B. Clark, et al., "Performance Parameters of Micro-Prilled Ammonium Nitrate—Fuel Blasting Targets", *International Symposium Mining Research* (Univ. of Mo., Rolla, Mo.; 1961). See also Robert J. Grubb, "Some Factors Influencing The Explosive Properties of Ammonium Nitrate-Fuel Mixtures", *International Symposium Mining Research* (Univ. of Mo., Rolla, Mo.; 1961), and K. Hino, et al., "Ammonium Nitrate-Fuel Surfactant Explosives," *International Symposium Mining Research* (Univ. of Mo., Rolla, Mo.; 1961).

U.S. Pat. No. 3,004,842 relates to substantially rigid or cast ammonium nitrate compositions comprising mixtures of ammonium nitrate, non-volatiles such as hydrocarbon oils and emulsifying agents such as fatty acid soaps or other anionic or non-ionic surface active agents. However, such ammonium nitrate explosives are not pourable, but must be especially processed in order to form the explosives into the desired shape prior to use.

U.S. Pat. No. 3,287,189 relates to grease-coated porous, particulate ammonium nitrate explosive compositions which are formed by dusting or otherwise blending particulate porous ammonium nitrate (either prilled, ground or otherwise classified particles) with from about 0.5 to about 2 wt % of a finely divided alkaline earth or earth metal salt of an aliphatic carboxylic acid of 8 to 24 carbons. The grease-coated ammonium nitrate can then be mixed with fuel oil to form an explosive composition. Alternatively, the ANFO can be admixed with an aqueous ammonium nitrate solution containing a thickening agent (e.g., a natural gum) to provide an aqueous slurry explosive containing from 3 to 15 wt % water. Such slurry explosives are characterized as ranging from a pourable slurry to a thick paste to provide a protective water-resistant grease coating in the pores of, and in the particles of, the ammonium nitrate, which are then admixed with the selected hydrocarbon fuel.

U.S. Pat. No. 3,540,953 relates to the use of ammonium nitrate prills optionally stabilized by incorporation of small amounts of magnesium nitrate or calcium nitrate in accordance with a certain procedure, wherein the prills have a particle density of at least 1.5 and are hard, smooth and relatively non-porous. The explosive compositions comprise a mixture of such prills, a carbon black and a liquid hydrocarbonaceous fuel. It is pointed out in the patent that previous attempts to use high density ammonium nitrate prills in explosive compositions had not been successful because the prills' surface militated against the requisite intimate contact between the ammonium nitrate and the other constituents of the explosive mixtures. Therefore, the '953 inventors employed a carbon black in an amount of from about 4 to 10 wt % of the ammonium nitrate, together with required weight ratios of carbon black to liquid hydrocarbon fuel, to form a free flowing explosive.

C. J. Dahn et al., *Proceedings 6th Conf. Soc. Explosive Engrs.*, 89–104 (1980) investigated the use in ANFO of cycled prills of high density ammonium nitrate, in which the cycled prills are formed in a controlled prilling process to create internal voids in the prills for increased fuel oil absorption.

U.S. Pat. No. 3,764,421 contacted an ammonium nitrate/fuel mixture with about 1 to 8 wt % water, based on the weight of the ammonium nitrate and the fuel oil. The ammonium nitrate is illustrated in the form of low density prills. The resulting mixture is aged until the prills can be crushed by pressing between the fingers. Thereafter, the mixing of the ingredients is completed until a substantial amount of the prilled ammonium nitrate has been converted to finely divided solids, of increased bulk density. However, it has been reported that the detonation velocity of moistened ANFO (at 94% AN, 6% fuel oil) decreases as moisture content is increased. George B. Clark, *Colorado School Mines Qtrly, supra,* at pp. 17–18. Also, this operation requires added steps in preparing the explosive at the mine site, since any beneficial effect of water is reported to only occur if velocities are measured within a few minutes after the water is added. J. J. Yancik, *Monsanto Blasting Products ANFO Manual,* "Explosive Properties and Performance Characteristics", pp. 20–21 (Feb. 13, 1969).

As is explained in U.S. Pat. No. 3,540,953, conventional ANFO explosives employ low density ammonium nitrate prills which have a particle density of up to about 1.45, and previous attempts to use high density ammonium nitrate prills and explosive compositions have centered about physical modification of the dense prills by roll-crushing, grinding, comminuting, water etching and the like to improve their oil retention. An example of water modification of ANFO is the method of U.S. Pat. No. 3,764,421, discussed above.

U.S. Pat. No. 3,779,821 relates to prilled ammonium nitrate compositions of improved anti-caking and anti-scattering properties for use as raw material in producing such explosive compounds as ANFO or for other commercial uses such as fertilizers. The patentee's compositions contain from 0.05 to 1.0 wt % (based on the prills' weight) of a petroleum hydrocarbon having a boiling point of greater than 150° C. and at least one anti-caking agent selected from the group consisting of (1) certain recited metal salts (Mg, Ba, Pb, Ca, Zn, Cu, Al, Cd) of $C_7$ to $C_{22}$ fatty acids (>40° C. melting point), (2) magnesium aluminate silicate, and (3) a compound of the formula: $R^1C(O)NHR^2NHC(O)R^3$, wherein $R^1$ and $R^3$ are each $C_{10}$ to $C_{20}$ alkyl and $R^2$ is $C_1$ to $C_2$ alkylene. The compositions are formed by one of two methods: (1) the petroleum hydrocarbon is first distributed and homogeneously mixed with a prilled ammonium nitrate, and the anti-caking agent is subsequently distributed and mixed with the prill/petroleum hydrocarbon particles; or (2) the petroleum hydrocarbon and anti-caking agent are simultaneously distributed and mixed homogeneously with the prills. The patentee prefers the use of low density prilled ammonium nitrate when the prills are to be used as raw materials in the preparation of explosive compounds such as ANFO.

Aqueous ammonium nitrate explosives are illustrated by U.S. Pat. No. 3,052,578, which relates to explosives comprising a blend of solid ammonium nitrate, a hydrocarbon fuel and an aqueous solution of dissolved ammonium nitrate, and employs a concentration of water in the total blend of from 5 to 20 wt %.

U.S. Pat. No. 3,161,551 disclosed ammonium nitrate containing emulsion sensitizers for blasting agents which comprise water-in-oil emulsions containing from about 50 to 70% by weight of ammonium nitrate, from about 15 to 35 wt % water and from about 5 to 20 wt % of a liquid organic sensitizer which has low solubility in water. Such emulsion sensitizers are then admixed with solid ammonium nitrate, such as by dropping the solid ammonium nitrate into a bore hole and then pouring the sensitized emulsion into the hole to completely cover the ammonium nitrate particles. Since these emulsions are employed to contact the solid ammonium nitrate in a ratio of emulsion to solid ammonium nitrate of from 1:4 to 1:0.5, the final explosive will theoretically contain from about 3 to 20 wt % water.

U.S. Pat. No. 3,164,503 relates to aqueous emulsified ammonium nitrate blasting agents containing nitric acid. The patent discloses granular mixtures of particulate ammonium nitrate containing from about 3 to 13 wt % of an aqueous solution of nitric acid, which itself contains from about 30 to 80 wt % of nitric acid and a total from about 4 to 13 of by weight of an insensitive, immiscible fuel material. The ammonium nitrate can be employed in the form of prills, pellets or granules and could be pre-treated to coat the ammonium nitrate with an mixture of 2.5 wt % microcrystalline wax (as the carbonaceous fuel), 2.5 wt % of high molecular weight isobutylene polymer, 20 wt % water, 17 wt % sodium nitrate, 57 wt % ammonium nitrate, and 1 wt % emulsifying agent.

U.S. Pat. No. 4,548,660 relates to water-in-oil emulsion explosives including an aqueous oxidizer solution, an oily material, an emulsifier and hollow microspheres wherein the oily material forming the continuous phase of the emulsion comprises an oil component and at least one polymer selected from the group consisting of epoxy resin, unsaturated polyester resin, polybutene, polyisobutylene, petroleum resin, butadiene resin and ethylene vinyl acetate copolymer. The poly-isobutylene polymer is a highly pure isobutylene polymer and is characterized by molecular weight of 5,000 to 140,000 (number average molecular weight). The emulsion explosive contains from about 2.5 to 38 wt % water.

U.S. Pat. No. 2,537,039 is directed to gelatinous explosive compositions, including ammonia dynamites (containing nitroglycerin and ammonium nitrate) with various tackifying agents. Also disclosed are certain non-nitroglycerin gelatinous explosives, including (in Example 34) one comprising 97.0% ammonium nitrate and 3.0% of a non-explosive gel, containing 95% petrolatum and 5% polyisobutylene (M. W. 80,000).

U.S. Pat. No. 2,541,389 is directed to ammonia dynamites which, in addition to normally non-cohesive dynamite ingredients, also include a viscous liquid polybutene product, such as polybutene attrition-resistant or anti-caking coating such as clay, diatomaceous earth or organic agents such as mixtures of sulfonates of mono- and/or dimethyl naphthalenes. Slurry mixtures are also disclosed containing from about 30 to 80 wt % of nitric acid and from about 3 to 65 wt % of a fuel, in addition to ammonium nitrate, an acid-resistant surfactant (e.g. sorbitan mono-oleate), and slurry stabilizer (e.g., high molecular weight copolymer of methyl vinyl ether-maleic anhydride; low density colloidal silica; polymers and copolymers derived from acrylamine; polyacrylic acid and other water soluble acrylic polymers).

U.S. Pat. No. 3,447,978 relates to invert emulsion blasting agents having (1) an aqueous solution component forming a discontinuous emulsion phase, (2) a carbonaceous fuel component forming a continuous emulsion phase, (3) an occluded gas component forming a discontinuous emulsion phase, and (4) a water-in-oil type emulsifying agent component (e.g., sorbitan fatty acid ester). Water is present in these explosives in a amount of from about 10 to 60 wt % based on 100 parts by weight of ammonium nitrate in the explosive. Nonvolatile water-insoluble polymeric or elastomeric materials of the group consisting of natural rubber, synthetic rubber, polyisobutylene, copolymers of butadiene-diarene, copolymers of isoprene-isobutylene, copolymers of isobutylene-ethylene and copolymers of related materials as well as terpolymers thereof were also said to be usefully employed in the carbonaceous fuel component to modify the fuel component to improve the retention of the occluded gas. Example 13 illustrates an invert emulsion (water-in-oil) blasting agent containing 17.1 vol. % occluded air, prepared from a having Staudinger molecular weights of between 40,000 and about 120,000. The resulting mixture is a cohesive dynamite product.

Slurry or gel explosives are also illustrated by U.S. Pat. No. 3,160,536 which is directed to mixtures of granular ammonium nitrate, a liquid hydrocarbon and a metallic soap which is employed in order to form a hydrocarbon-metallic soap of a gel-like consistency in order to coat the ammonium nitrate, rendering the mixture hydrophobic and permitting encasement within a water-impervious flexible plastic container for use as an explosive.

U.S. Pat. No. 3,919,016 relates to a process for thickening of hydrocarbon oil slurries of ammonium nitrate with a latex of an elastomer which is inverted into the nitrate slurry. Either natural or synthetic latices can be used, and specifically mentioned are latices containing from about 5 to 75 wt % of cis-1,4-polyisoprene and polyisobutylene, 25 to 75 wt % water and 0.01 to 5 wt % water-soluble surfactant. The process involves adding such a latex to a hydrocarbon oil slurry of ammonium nitrate in order to provide a polymer concentration in the hydrocarbon-oil slurry of from 0.01 to 20 wt %, followed by inverting the latex containing the polymer into a hydrocarbon oil slurry of ammonium nitrate by means of an oil soluble surfactant whereby the polymer contained within the latex is solubilized and the hydrocarbon oil slurry of ammonium nitrate is thickened. Example 2 in the patent illustrates the preparation of a thickened hydrocarbon oil-ammonium nitrate aqueous explosive containing about 3.3 wt % of a latex of polyisobutylene.

U.S. Pat. No. 4,278,480 relates to slurry type of explosives which are permanently tacky and which can be adhesively applied to surfaces for use as explosives. The invention admixes particulate ammonium nitrate with a polymer comprising a pourable isobutylene, which is semi-solid but fluent at room temperature. The patentee therefore was employing a low molecular weight polyisobutylene. The weight:weight ratio of the polyisobutylene to the fuel oil is disclosed to be from about 10:1 to 1:1, and the weight:weight ratio of the ammonium nitrate:fuel oil is disclosed to be from about 25:1 to 1:1. The explosives exemplified include the polyisobutylene at concentrations of from 20 to 25 wt %.

Japanese Patent Publication No. 53-124,604 (1978) relates to plastic explosives prepared by combining an explosive powder (penthrit or hexogen) and metal oxide with a binder obtained by mixing a lower paraffin with mineral oil or plant oil grease to form a softening agent which is then combined with a polymer such as polyisobutylene and dissolved by steam heating.

N. G. Kozhaeva, et al., *Neftepererabotka i Neftekhimiya* (Moscow), no. 6, pp 25–26 (1982) investigated the addition of polyisobutylene (20,000 to 300,000 viscosity average mol. wt.) to certain industrial lubricating oils for improving the tackiness of the oil, and reported an optimum mol. wt. of 85,000 for industrial lubricating oils of improved lubricity and increased viscosity and adhesion to metals. The authors recommended use of the 85,000 mol. wt. polyisobutylene in the form of a 3% concentrate in an indicated industrial oil as an additive in lubricant compositions for improving the tackiness of lubricating oils. However, the authors do not address the problems of forming dry, free flowing ammonium nitrate explosives, and in any event it is applicants' belief that the reference is directed to nonanologous art.

SUMMARY OF THE INVENTION

According to the present invention, improved dry ammonium nitrate blasting agents are provided comprising particulate high density ammonium nitrate in admixture with a liquid carbonaceous fuel and a high molecular weight polymer characterized by a high stringiness factor, to provide improved fuel retention of the fuel on the particles and thereby improved explosive storage properties. In particular, the explosives of this invention permit the use of high density ammonium nitrate prills in preparing such improved dry blasting agents. Such higher density particles allow the generation of higher explosion velocities, as compared to porous, low density ammonium nitrate particles of equivalent particle size. Such increased density particles permit the use of fewer bore holes for a given explosive use, thereby allowing considerable savings in terms of operating expense, equipment and manpower.

The ammonium nitrate particles are preferably coated with a metallic salt of a $C_6$ to $C_{24}$ aliphatic monocarboxylic acid, prior to contacting the particles with the fuel/polymer mixture. It has been surprisingly found that the retention time of the fuel/polymer mixture on the particles is greatly increased (and fuel drainage therefrom is therefore greatly retarded) if such metallic salts are used in combination with a polymer of the present invention, compared to the use of the polymer or the metallic salt coating alone. Further, it has been found that conventional clay (hydrated aluminum silicate) anti-caking coatings for ammonium nitrate do not co-act with the polymers of this invention to significantly improve the fuel/polymer retention time.

Whereas prior art ANFO explosives made with high density prills have not been stable to fuel oil drainage over extended time periods, the explosives of this invention can be stored for up to 2 weeks, and even longer, without substantial, detrimental drainage of the fuel oil from the particles. The enhanced storage stability of the ANFO explosives of this invention employing high density ammonium nitrate are particularly surprising in view of the art-recognized unsuitability of high density prills to hold the desired amounts of fuel oil. See, e.g., George B. Clark, "Basic Properties of Ammonium Nitrate Fuel Oil (ANFO)", *Colorado School Mines Qtrly,* Vol. 76, No. 1, pp. 1-32 (1981).

DETAILED DESCRIPTION OF THE INVENTION

Ammonium Nitrate

The ammonium nitrate component of the explosives of this invention will comprise particulate ammonium nitrate. As used herein, "particulate" ammonium nitrate means in the form of separate, discrete particles, e.g., prills, granules, pellets and fines, as opposed to cast or powdered ammonium nitrate or solutions thereof. "Powdered ammonium nitrate" refers to the very small particles of ammonium nitrate, e.g., of −60 Tyler screen mesh (250 microns) and smaller, normally associated with the production of granular, pelleted and prilled ammonium nitrate. Exemplary of the particulate ammonium nitrate are high density prills and crushed high density ammonium nitrate particles (such as fertilizer grade high density ammonium nitrate), of which high density ammonium nitrate prills are preferred. The untamped bulk density of the high density ammonium nitrate prills will generally be about from 0.85 to 0.95 gm/cc, preferably from about 0.88 to 0.93 gm/cc, as determined by weighing an untamped sample of the prills in a container of known volume. Preferably, the ammonium nitrate prills comprise miniprills, and are of a size such that at least about 95 wt % of the particles pass through a 12 Tyler screen mesh size and at least about 95 wt % of the particles are retained on 28 Tyler screen mesh. The particle size of at least 95% of the ammonium nitrate miniprills will preferably range from about 0.4 mm to 2.4 mm, and more preferably from about 0.5 mm to 1.7 mm. A typical size distribution of these miniprills is illustrated by prills in which 3.8 wt % of the prills are retained on a 12 Tyler screen mesh, 21.8 wt % are retained on a 14 Tyler screen mesh, 21.4 wt % are retained on a 16 Tyler screen mesh, 24.7 wt % are retained on a 20 Tyler screen mesh, 24.6 wt % are retained on a 28 Tyler screen mesh and 3.7 wt % pass through a 28 Tyler screen mesh, which Tyler screen mesh sizes correspond to 1.41 mm, 1.19 mm, 1.00 mm, 841 microns and 595 microns, respectively, in the U.S. sieve series. The miniprills provide high particle surface area and uniformity in particle shape, and permit higher packing density to be achieved in the explosive without "dead-packing", that is, the miniprills permit dense particle packing while retaining sufficient air void spaces between the explosive particles to permit the mixture to function effectively as an explosive. Furthermore, the high density miniprills provide greater amounts of the ammonium nitrate per unit volume of the explosive, further increasing the total energy release and explosive velocities which are attainable. It has also been observed (by photomicrographs of prill cross-sections) that miniprills have a hollow interior, thought to be a result of the rapid cooling in the prilling tower.

The high density ammonium nitrate prills which can be employed in the present invention can be made by conventional means, such as by spraying molten ammonium nitrate containing very little moisture (e.g. 0.1 to 0.4 wt % water, and preferably less than 0.2 wt % water) at elevated temperature (e.g. 175° C. or higher; particularly at 178°-182 ° C. or higher) into a prilling tower countercurrent to cooling air which solidifies the droplets into prills which are ultimately cooled to ambient temperature.

Preferably, the ammonium nitrate prills are stabilized to improve their physical properties (i.e., to provide greater hardness and resistance to caking, lower moisture sensitivity and/or breakdown in particle size, that is, "dusting") by providing in the ammonium nitrate melt, prior to prilling, any of the conventional ammonium nitrate stabilizers, such as natural phosphates, potassium metaphosphate, mono- and diammonium phosphate, ammonium sulfate, potassium chloride, magnesium salts, calcium salts, sodium silicate, clays, sodium, calcium and potassium nitrates, iron cyanides, metal oxides (e.g., magnesium oxide), etc. Preferred prill stabilizers, and methods of forming the improved prills, are disclosed in U.S. Pat. Nos. 3,317,276, 3,418,255 and 3,630,712, and in Canadian Patent Nos. 794,266 and 868,829, the disclosures of which are hereby incorporated by reference. Most preferably, the ammonium nitrate prills are stabilized with from about 0.1 to 2 wt % boric acid compound (BA), e.g., (boric acid and/or ammonium borate), from about 0.01 to 1 wt % diammonium phosphate (DAP) and from about 0.01 to 1 wt % diammonium sulfate (DAS), with the total such stabilizers comprising up to about 5 wt %, more preferably from about 0.08 to 0.35 wt %, of the ammonium nitrate prills and being present in the prills in a DAP/DAS weight:weight ratio of from 10 to 25:1, a BA/DAS weight:weight ratio of from 10 to 14:1, and DAP/BA weight:weight ratio of from 1 to 2:1.

Preferably, the particulate ammonium nitrate to be used in the explosives of this invention is also provided with a particle coating comprising metallic (e.g. alkali or alkaline earth, Zn, Cu, Fe, Al, Pb metal) salts of aliphatic monocarboxylic acids of 6 to 24 carbon atoms, such as sodium, zinc, copper, magnesium, potassium, calcium, barium and strontium salts of the following fatty acids: hexanoic acid, heptanoic acid, caprylic acid, capric acid, lauric acid, myristic acid, palmitic acid, stearic acid, oleic acid, tallic acid, and the like. Particularly preferred are calcium stearate and magnesium stearate. Such metallic carboxylic acid salts can be applied as powders (−325 Tyler mesh) by mixing with the particulate ammonium nitrate in a mixing drum. Metallic carboxylic acid salts are preferably applied in the substantial absence of water and in an amount of from about 0.001 to 1.0 wt %, more preferably from about 0.01 to 0.5 wt %, based on the weight of the ammonium nitrate particles passed to the coating step. Such metallic carboxylic acid salts can be admixed with the particles after suitable sizing or screening of the particles formed during prilling, to obtain the desired ammonium nitrate particle sizes for use in the explosives of this invention.

Carbonaceous Fuel

Fuel oil, and particularly No. 2 fuel oil, as well as No. 2 diesel fuel, are typical (and preferred) liquid carbonaceous fuels for compounding with ammonium nitrate to form the ANFO explosives of this invention. The specifications for No. 2 fuel oil are well-known: a flash point above 38° C., a 90% distillation point of 282 min. −338° C. max., and a maximum Saybolt Universal viscosity at 38° C. of 38 seconds (3.6 cSt) (ASTM D396-84 Standard Specifications for Fuel Oil). The specifications for No.2 diesel fuel are also well known (a flash point above 52° C.), and are set forth in ASTM D975 Standard Specification for Diesel Fuel Oils. Petroleum cuts sometimes referred to as low or partially refined oils are also suitable fuel components. Various other types of commercially available liquid hydrocarbons can be used. In fact, any liquid hydrocarbon that can be mixed in liquid form is suitable for the formulation of such blasting agents. Fuel oil may be partially or wholly replaced with one or more other oxidizable materials such as other hydrocarbon fractions derived from petroleum and similar fractions derived from other fossil fuels. These include heating oil, diesel fuel, jet fuel (particularly jet "A" fuel), oil, kerosene, lube oil, coal oil, kerogen extract (from shale oil) and the like. Oils derived from plant and animal origins and synthetic products such as alcohols (e.g. having a chain link of 6 to 18 carbons, or more), glycols, amines, esters, ketones and refined mineral oils (which are liquids at room temperature and preferably have a flash point above 38° C.) may also be used instead of fuel oil. Supplementary fuels of the saturated fatty acid type which are suitable for use in the carbonaceous fuel component include octanoic acid, decanoic acid, lauric acid, palmitic acid, behenic acid and stearic acid. Supplementary fuels of the higher alcohol type which are suitable for use in the carbonaceous fuel component include hexyl alcohol, nonyl alcohol, lauryl alcohol, cetyl alcohol and stearyl alcohol. Other miscible, carbonaceous materials useful as supplementary fuels in the carbonaceous fuel component include the vegetable oils such as corn oil, cottonseed oil and soybean oil. Carbohydrate materials exemplified by mannose, glucose, sucrose, fructose, maltose, and molasses may be added as supplemental fuels if desired.

Small amounts of high melting point waxes melting points of at least 38° C.; generally <1 wt % of the fuel) can also be used as a component of the carbonaceous fuel. Waxes which may be used in the carbonaceous fuel component include waxes derived from petroleum such as petrolatum wax, microcrystalline wax, and paraffin wax; mineral waxes such as ozocerite, and montan wax; animal waxes such as spermaceti; and insect waxes such as beeswax, and Chinese wax.

A petroleum oil of any desired kinematic viscosity may be used as a component of the carbonaceous fuel and may include oils having kinematic viscosities varying from a thin liquid to those (in minor proportions) which are so thick that they do not flow at ordinary temperatures. Kinematic viscosities at 25° C. for typical petroleum oils appear in the range of about 5 to about 4,000 cSt.

Most preferably, the liquid carbonaceous fuel(containing any such petroleum oil) possesses a kinematic viscosity of less than about 200 cSt, and still more preferably of from about 2 to about 100 cSt, as determined at 25° C.

The carbonaceous fuel component will be generally added in an amount from about 1 to about 13 parts by weight per 100 parts by weight of ammonium nitrate. In the preferred embodiment, the carbonaceous fuel component is added in an amount of about 3 to about 10 parts by weight per 100 parts by weight of ammonium nitrate.

Polymer

The polymers useful in the present invention are soluble in the selected liquid carbonaceous fuel at the desired concentration level of the polymer therein, are substantially non-reactive with ammonium nitrate, and are preferably characterized by a high stringiness factor ("h/c" Factor), as will be hereinafter defined, and are preferably substantially water-insoluble. The polymers are therefore hydrocarbon oil soluble, and preferably are soluble at a level of at least about 0.01 wt % of the polymer in the selected liquid carbonaceous fuel, and more preferably at least about 0.1 wt %, most preferably at least about 1 wt %, in the liquid carbonaceous fuel.

The polymers are preferably substantially chemically non-reactive with the ammonium nitrate under the temperature conditions in which the ammonium nitrate is contacted with the carbonaceous fuel/polymer mixture (as described below), and preferably are also substantially chemically non-reactive under such conditions with the metallic salts of the above-discussed higher carboxylic acids which when such salts are provided thereon as coating for the particulate ammonium nitrate.

The preferred polymers of the present invention are those characterized by an "h/c" factor ("h"=height, "c"=concentration) of at least about 1, and preferably at least about 5 to about 100, wherein "h/c" is the polymer's extensional viscosity equivalent, in units of cm/wt % polymer. The "extensional viscosity equivalent" of a polymer as used herein is intended to refer to the height to which a liquid column can be pulled, without breaking, from a container containing a solution of the polymer in a hydrocarbon solvent for the polymer by touching a 3.8 cm long×20 gauge syringe (flat tip) needle (0.023 in. I.D.) (connected to a vacuum pump) to the surface of the liquid, maintaining a vacuum above the polymer solution (at a temperature of about 25° C.), and moving the needle and solution apart at 5 mm/second (±1 mm/sec.) (e.g., by lowering the liquid container while keeping the needle point fixed, or by raising the needle above the liquid surface) to siphon the polymer solution. A measure is taken of the distance separating the liquid surface in the container and the needle point when the siphon breaks. The greater the distance separating the needle tip and the bulk liquid surface at the point at which the siphon breaks, the longer the tubeless siphon liquid column at the break point and, hence, the greater the stringiness of the polymers solution. The break height of a tubeless siphon is related to the extensional viscosity of a dilute polymer solution. The polymer concentration and hydrocarbon solvent should provide a polymer test solution having a kinematic viscosity of about 4 cSt (±1 cSt), at 100° C. Also, the vacuum used should be sufficient to maintain a substantially constant velocity of fluid flow through the needle. Generally, a vacuum of about −40 kPa will be employed. For more information, see K. K. K. Chao and M. C. Williams, *J. Rheology,* 27 (5) 451–474 (1983).

For a given chemical repeat unit in a polymer, variation in polymer properties results from molecular weight and molecular weight distribution variations. Among the repeat unit classes, the polymer size or contour length can also change even at a given molecular weight. The molecular weight distribution and contour length effects can be probed by such a simple rheological experiment to determine the siphon height. Polymeric materials which are effective in preventing oil drain-off in ANFO explosives made in accordance with this invention have been observed to exhibit "h/c" of greater than about 1, values. For each polymer repeating group, there will be a relationship between intrinsic viscosity, molecular weight and h/c factor. However, the simple measurement of h/c serves to provide uniform basis for comparing the stringiness measurements for all polymer classes.

Without intending to be limited thereby, it is believed that the improved fuel oil retention time on the ammonium nitrate particles is provided at least in part by the autoadhesion property of the polymers, which property is also sometimes referred to as stringiness. This polymer property can be envisioned as the tendency of the polymer molecules to undergo entanglement with one another. This autoadhesion property is related to (but distinct from) the adhesion property of the polymer, which is the tendency of the polymer to stick to other surfaces. The tackifier effect of polymer solutions can be quantified using the tubeless siphon test. The autoadhesion and adhesion of rubber compounds is discussed in J. R. Beattie, *Rubber Chem. Technology,* volume 42, pp. 1040–1053 (1969).

Polymers or copolymers of this invention may be synthesized from suitable monomers by thermal, irradiational or catalytic processes. The catalytic processes may be initiated by Ziegler, anionic, cationic or free radical types of catalysts. The specific catalyst chosen for a particular monomer will depend on a number of experimentally determined factors such as monomer reactivity and the peculiarities of chemical monomers structure as is well known in the art. Suitable monomers include propylene, butene-1, pentene-1, etc. Examples of suitable polymers of this invention include members selected from the group consisting of polyolefin type polymers, such as homopolymers of propylene (e.g., atactic polypropylene), butene-1, pentene-1, hexene-1, heptene-1, octene-1, nonene-1 and the like, hydrocarbon oil soluble polyolefin copolymers, such as alkene copolymers of ethylene-propylene, propylene-butylene, and hydrocarbon oil soluble copolymers and terpolymers of alkenes and dienes, such as ethylene-hexadiene, propylene-hexadiene, ethylene-propylene-hexadiene, ethylene-propylene-norbornadiene, and the like; hydrocarbon oil soluble arene-diene random and block copolymers, such as copolymers of styrene-isoprene (with and without hydrogenation), styrene-butadienes (with and without hydrogenation), methyl styrene-butadiene, tertiary butyl styrene-butadiene, methyl styrene-isoprene, tertiary butyl styrene-isoprene; polybutadiene; cis-polyisoprene; natural rubber; copolymers and tertiary polymers of $C_3$–$C_{20}$ alkyl styrenes (e.g., para-tertiary butyl styrene), acrylates, methacrylates, $C_1$–$C_4$ alkyl acrylates, and $C_1$–$C_4$ alkyl methacrylates, alkylfumarate-vinylacetate copolymers; polyalkylacrylates; polyisobutylene; copolymers of isobutylene and isoprene, hexadiene, norbornadiene, and divinyl benzene; homopolymers and copolymers of alkenes and vinyl esters (ethylene-vinyl acetate copolymers); and derivatives of the foregoing containing small amounts of polar groups attached to the polymer. Such polar modifications can be obtained by conventional means, such as by treatment of the polymer with maleic anhydride, or succinic anhydride, or by grafting of the polymer with vinyl pyridine, vinyl pyrolidine, sulfonated groups, sulfo-maleic groups, alcohols, ketones, ethers, etc.

A preferred class of polymers for use in the present invention are members selected from the group consisting of homopolymers of octene-1, alkene copolymers of ethylene and propylene, polyisobutylene, cis-polyisoprene and cis-polybutadiene. When cis-polyisoprene or cis-polybutadiene are employed, the polymer may be substantially linear, which is preferred as compared to the comb- or star-shaped polymers.

The foregoing polymers are known in the art and can be prepared by conventional means. For example, high molecular weight copolymers of $C_3$ to $C_{27}$ alpha-olefins and $C_4$ to $C_{20}$ vinyl alkylenecarboxylic acids may be obtained as described in U.S. Pat. No. 4,523,929 (exemplary of fuel anti-misting polymers); high molecular weight copolymers of $C_6$ to $C_{20}$ alpha-olefins may be obtained as described in U.S. Pat. No. 3,692,676 (exemplary of drag reducing polymers); and high molecular weight cis-polyisoprenè, cis-polybutadiene, and ethylene-propylene copolymers may be prepared as described in U.S. Pat. No. 3,493,000 (also exemplary of drag reducing polymers), the disclosures of which patents are hereby incorporated by reference.

The polymers having an "h/c" factor of greater than about 1 will generally have a high molecular weight in order to possess the requisite degree of minimum polymer tackiness, although the exact molecular weights will differ considerably depending on the type of polymer. For example, the polyisobutylene will generally have a "h/c" factor of at least about 1 to about 100, and more preferably at least about 5 to about 60, and will comprise either a homopolymer of isobutylene or a copolymer of isobutylene and isoprene, styrene or divinyl benzene. Generally, useful polyisobutylene polymers have a viscosity average molecular weight of 500,000 to 10,000,000, and more preferably from about 800,000 to 5,000,000. Viscosity average molecular weight ("$M_v$") of polyisobutylene can be calculated using an intrinsic viscosity [n](in deciliters/gm) in diisobutylene at 20° C. and the relationship:

$$M_v = \left[ \frac{[n]}{0.00036} \right]^{1.56}$$

Flory, *Principles of Polymer Chemistry,* p. 312 (Cornell 1953).

It has also been observed that high molecular weight styrene-isoprene, co-polymers, polymethacrylate, and linear polyisoprenes, having viscosity average molecular weights of at least about 90,000 (up to, for example, 10,000,000), can also be employed as a polymer component of the dry blasting agents of this invention, although the h/c Factor for these classes of polymers has been observed to be nil, as will be shown in the working examples below.

The polymer component of the explosives is preferably added to the ammonium nitrate as a hydrocarbon oil solution of the polymer. Such hydrocarbon oil solvents can comprise any of the above carbonaceous fuels. Preferably, the polymer is (either the polymer per se, or a polymer concentrate, as described below) is first admixed with the carbonaceous fuel (e.g. at room or at elevated temperatures, 20° to 120° C., with stirring), and the resulting polymer/fuel mixture is then applied to the ammonium nitrate particles as, for example, by spraying or by pouring onto the particles and blending.

The polymer component of the explosives can be conveniently added to the carbonaceous fuel as a polymer concentrate, for ease of handling and transport of the polymer to the mine site. This polymer concentrate can comprise polymer mixed with a hydrocarbon diluent or solvent for the polymer. The concentrate can then be blended at the site with additional quantities of the selected bulk carbonaceous fuel (which can comprise the same or different fuel used in the concentrate itself), prior to contacting the finally prepared polymer/fuel mixture to the ammonium nitrate to form the explosives of this invention. Such polymer concentrates will preferably have a kinematic viscosity of from about 300 to 3,000 cSt (at 100° C.) for ease of handling of the concentrate. Ammonium nitrate blasting agents of particularly improved properties have been formed using polymer concentrates of this invention wherein the hydrocarbon oil diluent is characterized by an aniline point (ASTM D611) of less than about 95° C., preferably less than about 90° C., and most preferably from about 50° to 85° C. Such low aniline point hydrocarbon diluents are believed to exhibit good solvency for the high molecular weight, high "h/c" factor polymers of this invention. In the event a hydrocarbon diluent having an aniline point of greater than about 95° C. is chosen, preferably it is employed in admixture with a second hydrocarbon diluent having an aniline point less than about 95° C. in amounts effective to provide a hydrocarbon diluent mixture which is characterized by an aniline point of less than about 95° C., preferably less than about 90° C., and most preferably from about 50° to 85° C. Since aniline points of hydrocarbons are generally expected to decrease with the increase in their aromatic and/or naphthenic content, the selected hydrocarbon diluent, if having an aniline point greater than about 95° C., can be admixed with a source of such naphthenic or alkyl aromatics (including, but limited to, naphthenics such as cyclohexane and aromatics such as benzene and alkyl aromatics, such as toluene, xylene and other alkyl substituted benzenes of 7 to 10 carbon atoms) to provide the hydrocarbon diluent mixture of the desired low aniline point for use in formulating the polymer concentrates of this invention. Examples of such hydrocarbon diluents are fuel oil, petroleum cuts (including hydrofined and mildly solvent extracted petroleum cuts), and carbonaceous liquid fuels described above. Severely extracted petroleum cuts are not preferred desired as diluents since such severely extracted cuts have aniline points of about 100° C. or higher. Exemplary of such non preferred diluents are white oils, satisfying F.D.A. Regulations 21 Code of Federal Regulations (Section 178.3620) as mineral oils.

Preferred as polymer concentrates are liquid solutions of polyisobutylene in hydrocarbon diluent having an aniline point (ASTM D611) of from 50° to 95° C., wherein the polyisobutylene concentration is from about 1 to 10 wt % (and most preferably from 4 to 8 wt %) of the total concentrate and wherein the polyisobutylene has a viscosity average molecular weight of from about 500,000 to 10,000,000 and an "h/c" factor of at least about 5.

Such polymer concentrates will be generally added to the bulk carbonaceous fuel in a bulk fuel:polymer concentrate weight:weight ratio of from about 1:1 to 20:1, and more preferably from about 2:1 to 10:1, to form the polymer/fuel mixtures of this invention intended for use in admixture with the particulate ammonium nitrate.

The polymer/fuel mixtures of this invention should contain an amount of polymer effective to improve the retention of the liquid carbonaceous fuel on the surface of the particulate ammonium nitrate. Preferably, the polymer is employed in the polymer/fuel mixture, in an amount effective to provide a kinematic viscosity of the polymer/fuel mixture of not greater than about 300 cSt (at 25° C.), and more preferabley a kinemmatic viscosity of from about 20 to 250 cSt (at 25° C.). More preferably, the polymer/fuel mixtures will contain an amount of polymer sufficient to provide in the polymer/fuel mixture, an "H" factor of at least about 5, preferably at least about 10, and more preferably from at least about 25 to about 200, wherein H is defined by the following expression:

$$H = h/c \times C'$$

wherein h/c is the extensional viscosity equivalent of the polymer as defined above and C' is the concentration of the polymer, in weight percent, in the polymer/fuel mixture.

As is the case for the polymer concentrates, it is preferred that the polymer/fuel mixtures of this invention be characterized by aniline points (ASTM D611) of less than about 95° C., more preferably less than about 90° C., and most preferably up from about 50° to 85° C. Such low aniline points can be achieved if needed as described above, by mixing a higher aniline point carbonaceous fuel with a second low aniline point carbonaceous fuel. No. 2D fuel oil generally has an aniline point of from about 25° to 87° C., and preferably from about 50° to 83° C., and is preferred.

Especially preferred fuel/polymer mixtures for use in contacting of particulate high density ammonium nitrate (especially miniprills) are liquid mixtures comprising from about 98 to 99.5 wt % liquid carbonaceous fuel having an aniline point (ASTM D611) of less than 90° C. (and most preferably less than 85° C.) (e.g., No. 2 fuel oil) and from about 0.5 to 2.0 wt % of polyisobutylene having a viscosity average molecular weight of from about 500,000 to about 10,000,000 (and still more preferably from about 800,000 to 5,000,000) and an "h/c" factor of at least about 5.

The polymer component of the explosives of this invention can also contain any of the conventionally used polymer antioxidants, for example, hindered phenols, of which butylated hydroxy toluene (BHT) is typical. Where employed these antioxidants will be used in amounts from about 1 to 2 wt % of the antioxidant based on the total weight of the polymer.

Optional Additives

The fuel/polymer mixtures of this invention can also contain hydrocarbon oil soluble surfactants miscible with the fuel/polymer mixture in order to improve the flowability of the explosive particles produced in the process of this invention. Such surfactants include $C_1$ to $C_{20}$ alkyl esters of $C_6$ to $C_{24}$ aliphatic carboxylic acids (such as any of the above-mentioned acids discussed as suitable for the ammonium nitrate metallic salt coating), and are illustrated by isopropyl oleate, glycerol monooleate, glycerol di-oleate, sorbitan mono-palmitate, sorbitan mono-oleate and the like. Such surfactants will be generally employed in an amount of from about 0.001 to 0.1 wt %, more preferably from about 0.002 to 0.2 wt %, based on the weight of the ammonium nitrate.

Various modifiers, densifiers and sensitizers can be conventionally incorporated into the compositions of this invention to enhance their characteristics or to render them particularly suitable for specific purposes. Such additives include for example, aluminum, magnesium, aluminum-magnesium alloys, ferrophosphorus, ferrosilicon, lead and its salts, sulfur, trinitrotoluene, ground smokeless powder, polystyrene beads, sawdust, corn meal, wheat flour, and other conventional blasting agent components. If desired, oil-soluble dyes may be added to produce a colored product for safety reasons (to distinguish unprocessed ammonium nitrate and the ANFO explosive particles) and to provide a visual aid in determining whether the fuel oil and the ammonium nitrate are adequately mixed. A portion of the particulate ammonium nitrate component can also be replaced by alkali metal nitrates (e.g., sodium and potassium nitrate), alkaline earth metal nitrates (e.g. calcium, magnesium and barium nitrates), and zinc nitrate. These additional components may be employed as auxilliary sensitizers for the sodium nitrate. Where employed, these additional materials will be generally added in a amount of from about 0 to 20 parts per weight, and preferably up to about 10 parts per weight, based on 100 parts by weight of the particulate ammonium nitrate.

Process of Making The Explosive

The compositions of the present invention can be formulated by bringing the particulate ammonium nitrate, carbonaceous fuel and polymer into contact with one another and mixing them until the ammonium nitrate particles are coated with the fuel/polymer nitrate. The sequence of addition is not critical but for ease of operation it is preferred to add the polymer (as such or as a polymer concentrate) to the liquid carbonaceous fuel and mix these two components until the polymer is evenly distributed in the fuel oil. The fuel oil/polymer mixture is then preferably applied to the ammonium nitrate to distribute the fuel/polymer mixture over the particles. Any of the above optional additives that are to be incorporated into the composition may be added simultaneously with, or subsequent to, the fuel/polymer mixture.

The compositions of the present invention can be prepared in conventional apparatus and either continuously, semi-continuously or batch-wise. When a batch method of operation is used, a ribbon blender or any other commercially available mixers will be satisfactory. For continuous operation, it is preferred to use a screw conveyer in which the fuel and polymer are added to the ammonium nitrate as it progresses along the path of the conveyer. When the present compositions are thus made continuously, the conveyer can be positioned to charge the finished product directly into the bore hole.

The dry blasting agent product thus obtained is comprised of free-flowing solid particles comprising ammonium nitrate, e.g. high density miniprills, coated with a combination of the carbonaceous fuel and polymer. Such free-flowing solids can be readily poured from a vessel tipped at an angle of from about 45° to 70°, relative to the horizontal, with substantially no sticking of the solid particles to the vessel walls. The explosive can be readily initiated with (a 1 lb. booster of nitroglycerine, tetryl or pentaerythritol tetranitrate). When thus initiated the present compositions are self-propagating when confined in columns as small as about 3 inches in diameter. Such compositions can be detonated to produce the energy required to shatter and throw ore and rock. The untamped bulk density of the explosive compositions of this invention ranges from about 0.9 to 1.2 grams per cubic centimeter, and preferably from about 1.0 to 1.15 grams per cubic centimeter.

The explosives of this invention are substantially dry, that is, contain less than about 1 wt % water, more preferably less than about 0.5 wt % water, and most preferably less than about 0.2 wt % water.

Typical explosive compositions of this invention can be illustrated by reference to Table 1.

TABLE I

| | ANFO Explosive Components (wt %) | | |
|---|---|---|---|
| | Ammonium Nitrate | Polymer Component | Carbonaceous Fuel Component |
| Broad | 90 to 98 | 0.01 to 1.0 | 2 to 9 |
| Preferred | 92 to 96 | 0.03 to 0.15 | 4 to 8 |
| More Preferred | 93 to 95 | 0.04 to 0.1 | 5 to 7 |

The free-flowing nature of the dry blasting agents of this invention advantageously permit the pouring of the mass which is composed of discrete particles. This contrasts to gel explosives, which comprise colloidal solutions of coherently dispersed ammonium nitrate particles. Such gel explosives are jelly-like and resist flow, acting as an elastic solid under shearing conditions below the gel's critical shearing stress limit.

The improved ANFO explosives, and their preparation and use will be more readily understood by reference to the following illustrative preferred embodiments thereof. In these examples and throughout the specification, all proportions are expressed in parts by weight unless otherwise indicated.

In the Examples, the "h/c" extensional viscosity limits were determined by dissolving a sufficient amount of the indicated polymer in Norpar® 15 solvent ($C_{15}$ normal paraffin) to make 100 grams of a 1.0 wt % polymer solution (4 cSt at 100° C.). The polymer and solvent were added to a 250 ml beaker and the contents were stirred with a stirring bar until solution was complete. The sample beaker was then L placed on a lab jack (Ace Model #19-1585-01), and the jack was adjusted so that a 1.5 inch long×20 gauge syringe (flat tip) needle (0.023 in. I.D.) (which was connected by 3 mm. o.d. siphon tubing to a siphon pump, and which was supported by a ring stand) touched the surface of the liquid sample (quiescent, room temperature liquid). A measurement was taken with the ruler in cm. of the height of the jack relative to a fixed point (e.g. lab bench surface). The vacuum was started to begin the siphon (−40 kPa constant vacuum), and the jack was slowly lowered (about 5 mm/sec) until the siphon broke. A measure was taken of the jack height from the same fixed point, and the siphon break height was calculated by difference. The break height was repeated a total of five times, and the average was taken and reported as the "h/c" value for the polymer.

In the Examples, ether extractions were conducted by placing a 15 gm ANFO sample in a pre-weighed crucible containing filter paper, and re-weighing to 0.0001 gm accuracy on an analytical balance. The crucible was then suspended in a wire sling below a metal Wiley Condenser, and 60 mls of ether were added to the Wiley tube. The condenser and crucible were then placed inside the Wiley tube, and, with cold water cooling the condenser, the ether was refluxed over the solids by use of a steam bath for 1 hour. The crucible was then removed from the condenser and subjected (about 5 sec.) to a vacuum drawn through the small holes in the bottom of the crucible, to remove any liquid ether therefrom and placed in a 90° C. oven for 20 minutes. Thereafter, the crucible was allowed to cool and was re-weighed. The loss in crucible weight divided by the weight of the ANFO sample×100 was calculated and is reported hereafter as the ether extractibles. Therefore, the ether extractibles reflect the quantity of ether soluble substances adsorbed on the ammonium nitrate particles.

In the Examples, velocities of detonation were determined by the spike velocity technique (*Blasters' Handbook*, pp. 38–41, Du Pont, 1978) using velocity targets (each comprising two wires twisted together, with the bare ends coated with vinyl) which were spaced 10 inches apart.

Aniline points are determined by ASTM Method D611.

EXAMPLES

Examples 1–4: Oil Retention and Velocity of Detonation Tests

A series of four samples of ANFO, each about 20 kilograms, were prepared from high density ammonium nitrate (AN) miniprills, high molecular weight polyisobutylene tackifier and No. 2 diesel fuel. The AN miniprills were obtained by prilling a 99.6 wt % molten ammonium nitrate melt to which was added about 0.1 wt % of boric acid, about 0.13 wt % of diammonium phosphate and about 0.01 wt % diammonium sulfate, to form prills which were cooled, and screened to recover dry, free-flowing miniprills which were found to have the particle size distribution set forth in Table II below:

TABLE II

| Tyler TM Sieve Size | U.S. Sieve Size (mm) | Wt % Retained On The Sieve | Cummulative % Retained On |
|---|---|---|---|
| No. 6 | 3.36 | 0.00 | 0.00 |
| No. 10 | 1.68 | 0.96 | 0.96 |
| No. 14 | 1.19 | 22.46 | 23.42 |
| No. 20 | .841 | 51.03 | 74.45 |
| No. 28 | .595 | 23.93 | 98.38 |
| No. 35 | .420 | 1.14 | 99.52 |
| No. 100 | .149 | 0.44 | 99.96 |
| Through No. 100 | .149 | 0.04 (1) | — |

Notes:
(1) wt % particles passing through No. 100 sieve.

The AN miniprills were then coated with powdered calcium stearate (<44 micron particles) in a rotary drum to provide a substantially uniform calcium stearate coating on the miniprills. The amount of calcium stearate used was 0.09 wt % calcium stearate, based on the ammonium nitrate miniprills charged to the rotary drum.

All explosive samples were formed by charging the dry, free-flowing ammonium nitrate miniprills, coated as above with calcium stearate, to a cement mixer to which was then added a liquid mixture containing the No. 2 diesel fuel oil (aniline point=60° C.) and a hydrocarbon solvent containing the high molecular weight polyisobutylene in order to form dry, free-flowing ANFO miniprills having the compositions set forth in Table III below. The hydrocarbon solvent mixture containing the high molecular weight polyisobutylene comprised PARATAC® tackifier (2,500 cSt at 100°

C.) (Esso Chemical Canada), 5 wt % solution of polyisobutylene in a lubricating oil, ISO VG22, dewaxed, hydrofined solvent-extracted mineral oil, 20 cSt @40° C.; pour point −12° C.; aniline point 93° C.). The polyisobutylene in solution had a viscosity average molecular weight of about 1,130,000, and a 1 wt % 0 solution of the tackifier (in Norpar® 15 solvent) was found to have a "h/c" value of about 5.3. A control ANFO explosive was also prepared using the high density ammonium nitrate miniprills, coated with calcium stearate as above, and the No. 2 diesel fuel oil without added polymer (Control A).

TABLE III

| | ANFO COMPOSITIONS (wt %) | | | |
|---|---|---|---|---|
| Example No. | AN (1) | PIB (2) | Fuel Oil (3) | Polymer/Fuel Mixture H Factor (4) |
| 1 | 94.4 | 0.032 | 5.568 | 3.0 |
| 2 | 94.4 | 0.056 | 5.544 | 5.3 |
| 3 | 94.4 | 0.081 | 5.519 | 7.7 |
| 4 | 94.4 | 0.10 | 5.50 | 9.5 |
| Control A | 94.4 | 0 | 5.6 | 0 |

Notes:
(1) AN = ammonium nitrate miniprills, with 0.09 wt % calcium stearate coating.
(2) PIB = polyisobutylene in solution, 1,130,000 viscosity average mol. wt., h/c value = 5.
(3) Fuel oil = #2 diesel fuel + hydrocarbon oil component of added PIB/hydrocarbon oil solution.
(4) Example of Calculation: H (Ex. #1) = [.032 ÷ (.032 + 5.568)] × 100 × 5.3 = 3.03.

Eight samples from each 20 kg batch were poured into 105 cm lengths of 3" sch 40 steel pipe and the samples tamped in the pipe. The bulk density of the tamped ANFO was about 0.98 g/cm$^3$ (untamped bulk density=0.93 gm/cm$^3$). The pipes were stored in an upright position at room temperature (20° C.). After each of 1, 4, 8, 24, 30, 40, 50 and 60 days' storage, one of the eight samples was taken, and a small, weighed amount (about 15 gms) of the ANFO from the upper portion of the ANFO column was refluxed with ether. (The ether extractibles are believed to have comprised the hydrocarbon components of the fuel/polymer mixture in addition to at least a portion of the calcium stearate coating additive.) The remainder of each sample was detonated in a 3-inch diameter schedule 60 steel pipe at 5° C. using a No. 12 blasting cap and a 0.45 kg TNT primer. The following results were obtained.

TABLE IV

| | Ether Extractibles (wt %) Storage After Day No. | | | | | | | | |
|---|---|---|---|---|---|---|---|---|---|
| Example No. | 1 | 4 | 8 | 24 | 30 | 40 | 50 | 60 | % Improved Retention (1) |
| Control A | 3.86 | 3.5 | 3.0 | 2.9 | 2.9 | 2.9 | 2.9 | 2.9 | — |
| 1 | 5.18 | 5.2 | 4.5 | 4.1 | 4.0 | 4.0 | 3.9 | 3.6 | 25 |
| 2 | 5.15 | 5.2 | 5.1 | 4.2 | 4.6 | 4.4 | 4.4 | 4.2 | 46 |
| 3 | 5.72 | 5.6 | 5.6 | 5.4 | 5.4 | 5.4 | 5.4 | 5.3 | 85 |
| 4 | 5.82 | 5.8 | 5.8 | 5.8 | 5.8 | 5.8 | 5.71 | 5.72 | 97 |

Note:
(1) Ether extractibles in Examples 1–4 after 60 days relative to 60 day ether extractibles in Control A.

TABLE V

| | Velocity of Detonation (meters/sec) After Indicated Storage Day No. | | | | | |
|---|---|---|---|---|---|---|
| Example No. | 1 | 8 | 24 | 30 | 40 | 60 |
| Control A | 2581 | 1979 | 1857 | 1766 | F | F |
| 1 | 3486 | 3228 | 2978 | 2703 | 2632 | 2500 |
| 2 | 4080 | 4019 | 4055 | 4084 | 4230 | 3894 |
| 3 | 4110 | 4004 | 4095 | 4178 | 4198 | 3997 |
| 4 | 4202 | 4123 | 4145 | 4236 | 4086 | 3983 |

F - failed to detonate.

The above results clearly demonstrate that when the high molecular weight polyisobutylene tackifier was employed, the rate of fuel drainage from the column of ANFO was greatly decreased, and that the shelf life was greatly improved in Examples 1 through 4 relative to Control A. The increased rate of fuel oil drainage from Control A causes an imbalance in the fuel/oxidizer ratio and leads to a lowering of the velocity of detonation. Such imbalance would lead to poor explosive performance and the production of "fumes".

Examples 5–6:

Employing the high density ammonium nitrate miniprills having the size distribution identified in Table VI below, small samples (about 5 gms each) of ANFO were prepared by hand in which the miniprills were contacted with the No. 2 diesel fuel oil (as in Example 1) and high molecular weight polyisobutylene, and the miniprills in this Example were not coated with calcium stearate. The polyisobutylene-source comprised PARATAC® tackifier as used in Examples 1 through 4. The fuel oil and polyisobutylene source were first mixed in a fuel oil/polyisobutylene-source weight:-weight ratio of 4.3:1.7 (H factor=7.5) and then blended with the ammonium nitrate miniprills such that the weight ratios of AN/fuel oil/polyisobutylene-source were 94/4.3/1.7. Therefore, the ANFO contained about 0.09 wt % of the high molecular weight polyisobutylene, about 94 wt % ammonium nitrate and about 5.91 wt % combined fuel oil and hydrocarbon solvent component of the polyisobutylene-source. All of the ANFO samples were dry and free-flowing particles. Each sample was placed in a glass graduated cylinder of about 200 milliliters capacity. The samples stored at room temperature (20° C.) for two days, and the ether-extractibles were then determined as in Examples 1–4. The data thereby obtained is also set forth in Table VI.

A control without polyisobutylene was prepared (Control B) by soaking uncoated high density miniprills in excess No. 2 diesel fuel oil for 15 minutes at room temperature. The excess fuel oil was then removed from the miniprills by centrifuging, and the fuel oil absorbed on the miniprills was calculated by difference to provide simulation of 1-day ether extractibles, determined by the above descibed method.

TABLE VI

| Particle size distribution (Cummulative %) | | |
|---|---|---|
| Tyler Sieve | Example 5 | Example 6 |
| No. 6 | 0.0 | 0.0 |
| No. 10 | 70.4 | 36.0 |
| No. 14 | 99.6 | 96.7 |
| No. 20 | 99.8 | 99.2 |

TABLE VI-continued

| Particle size distribution (Cummulative %) | | |
|---|---|---|
| No. 28 | 99.9 | 99.8 |
| No. 35 | 99.9 | 99.9 |
| No. 100 | 99.9 | 99.9 |
| Through No. 100 | 0.1 | 0.1 |
| Untamped bulk density g/cm$^3$ | 0.94 | 0.93 |
| Ether extractibles | 2.95% | 3.41% |

| Tyler Sieve | Control B |
|---|---|
| No. 6 | 0 |
| No. 12 | 0.8 |
| No. 14 | 18.2 |
| No. 16 | 21.4 |
| No. 20 | 27.4 |
| No. 28 | 28.5 |
| Through No. 28 | 3.7 |
| Untamped bulk density, g/cm$^3$ | 0.93 |
| Fuel oil retained | 2.8% |

The above results illustrate the improved fuel oil retention which is achieved by use of the polyisobutylene in accordance with the present invention, even in the absence of a coating on the ammonium nitrate. When comparing the above ether extractibles after two days of storage in Examples 1 through 4 of Table IV, it is clear that the coating of the metal salt of a carboxylic acid greatly prolongs the retention of the fuel oil/-polymer mixture on the ammonium nitrate high density miniprills when used in combination with a polymer of this invention.

Examples 7–10

The procedure of Example 6 was repeated (except that the miniprills were first coated with the selected metallic stearate salt, as in Example 1) to prepare samples of dry, free-flowing ANFO comprising 94 wt % high density ammonium nitrate miniprills, 4.3 wt % fuel oil and 1.7 wt % PARATAC® tackifier (as used in Examples 1–4). The data thereby obtained are set forth in Table VII. From these data, it can be seen that metallic stearate salts improved the fuel oil retention over the use of the PARATAC® tackifier alone, and that the calcium and magnesium salts were particulary beneficial.

TABLE VII

| Example | Metallic Stearate Salt Coating (1) | Ether Extractibles After Day No: 1 | 7 | 14 |
|---|---|---|---|---|
| 7 | Calcium Stearate | 5.8 | 5.8 | 5.2 |
| 8 | Magnesium Stearate | 5.8 | 5.8 | 5.2 |
| 9 | Zinc Stearate | 4.8 | 4.3 | 3.5 |
| 10 | Aluminum Stearate | 4.9 | 4.4 | — |
| 5 | None | 3.41 | — | — |

Notes:
(1) Metallic salt coating = 0.1 wt % on ammonium nitrate miniprill charged to coating step.

Examples 11–19

A series of polymer solutions were dissolved at room temperature (or with heating to 38° C., as needed) in a carbonaceous fuel to determine "h/c" values. All "h/c" values were determined with the solutions at room temperature. The data thereby obtained are set forth in Table VIII below. Each polymer solution was then used as a polymer concentrate and admixed with No. 2D fuel oil to formulate polymer/fuel mixtures comprising 28.33 wt % of the polymer solution and 71.67 wt % of No. 2 diesel fuel oil (aniline point=60 ° C.). The H factors for each mixture was calculated, (based on the h/c factor of Table VIII and the polymer concentration in the resulting polymer/fuel mixture) and is indicated in Table IX. Following the procedure of Examples 7–10, each polymer/fuel mixture was contacted with ammonium nitrate miniprills employed as in Examples 7–10 (coated with magnesium stearate) to form ANFO samples containing 94 wt % ammonium nitrate, 4.3 wt % fuel oil and 1.7 wt % polymer solution, which were then tested to determine the fuel drainage rates, expressed as ether extractibles. The data thereby obtained are summarized in Table IX.

TABLE VIII

| Example No. | Polymer Type | Polymer Mol. Wt. (Vis. Avg.) | Polymer Solution Diluent | Diluent Aniline Pt. (°C.) | Polymer Conc., Wt. % | Kin. Vis. (cSt @ 100° C.) | Test Solvent | Tubelss Siphon Test K.V. of Solution (cSt @ 100° C.) | Tubelss Siphon Test h/c (cm./wt. %) | K.V. of Blend of 28.3 mol. % Polymer Solutions in #2D Fuel Oil (12) |
|---|---|---|---|---|---|---|---|---|---|---|
| 8 | PIB | 1.13 × 10$^6$ | Solvent Extracted Mineral Oil | 95.1 | 5.0 | 2,500 | Norpar ® 15 (11) | — | 5.3 | 109 |
| 11 | PIB | 514,000 | 75/25 Solvent Neutral (100 LP/150 RP) (9) | 100 | 8.7 | 2817 | Norpar ® 15 | N.A. | 0.9 | 123 |
| 12 | PIB (1) | 965,000 | (Same as Ex. 11) | 100 | 5.8 | 2990 | Norpar ® 15 | N.A. | 2.9 | 110 |
| 13 | PIB (2) | 1.15 × 10$^6$ | Witco Semtol 40-30 white oil | 94.5 | 5.8 | 3175 | Norpar ® 15 | N.A. | 6.8 | 137 |
| 14 | SI (3) | 90,000 | Solvent Neutral Oil | N.A. | 12.0 | 1480 | Norpar ® 15 | 21.5 | Nil | 143 |
| 15 | SI (4) | 150,000 | Solvent Neutral Oil | N.A. | 6.0 | 3660 | Norpar ® 15 | N.A. | Nil | 89 |
| 16 | PMA (5) | 400,000 | N.A. | N.A. | 34 | 1160 | Norpar ® 15 | 1.6 | Nil | 93 |
| 17 | EPH (6) | 354,000 | N.A. | N.A. | 3.3 | 279 | Norpar ® 15 | N.A. | 1.7 | 37 |
| 18 | SNR (7) | 1.55 × 10$^6$ | Exxsol ® D-100 (10) | 81 | 6.9 | 1608 | Norpar ® 15 | N.A. | 0.8 | 44 |
| 19 | EP (8) | 250,000 | Witco Semtol | 94.5 | 5.0 | 489 | Norpar ® | N.A. | 2.6 | 52 |

TABLE VIII-continued

| Example No. | Polymer Type | Polymer Mol. Wt. (Vis. Avg.) | Polymer Solution Diluent | Polymer Solution Diluent Aniline Pt. (°C.) | Polymer Conc., Wt. % | Kin. Vis. (cSt @ 100° C.) | Test Solvent | Tubelss Siphon Test K.V. of Solution (cSt @ 100° C.) | Tubelss Siphon Test h/c (cm./wt. %) | K.V. of Blend of 28.3 mol. % Polymer Solutions in #2D Fuel Oil (12) |
|---|---|---|---|---|---|---|---|---|---|---|
| | | | 40-30 | | | | 15 | | | |

Notes:
N.A.: Not Available; T.V.T.M.: Too Viscous To Measure; SNR = Synthetic Natural Rubber (cis-polyisoprene); PIB = Polyisobutylene; EP = Ethylene-Propylene Co-Polymer; SI = Styrene-Isoprene Co-Polymer; EPH = Ethylene-Propylene-Hexadiene Terpolymer. K.V. = Kinematic viscosity.
(1) Vistanex ® MM L-120 (Exxon Chemical Americas).
(2) Vistanex ® MM L-140 (Exxon Chemical Americas).
(3) Shell Star ® 250 Hydrogenated Star-Branched SI (Shell Chemical Company).
(4) Styrene-Isoprene Block Polymer, Shell Vis ® 40, 6% conc. (Shell Chemical Company).
(5) Polyalkylmethacrylate
(6) Ethylene Propylene Hexadiene Terpolymer, Calumet TA-50 (Calumet Refining Co.).
(7) Synthetic Natural Rubber (cis-polyisoprene) Nat Syn ® 2205 (Goodyear Rubber Co.).
(8) Vistalon ® 404 Ethylene-Propylene Broad M.W. Dist. Co-polymer (Exxon Chemical Americas).
(9) 75:25 wt:wt blend solvent extracted neutral oils (Exxon Company U.S.A.).
(10) Dearomatized Kerosene (<1 wt % aromatics) (Exxon Chemical Americas).
(11) Hydrocarbon solvent (Exxon Chemical Americas).
(12) cSt at 23°.

TABLE IX

| Example No. | Polymer (1) | H Factor (2) | Diluent Aniline Pt. (°C.) | Ether Extractibles (wt %) 1 day | 7 days | 14 days |
|---|---|---|---|---|---|---|
| Control B (3) | — | — | — | 2.8 | — | — |
| 8 | PIB | 7.5 | 93 | 5.8 | 5.8 | 5.2 |
| 11 | PIB | 2.2 | 100 | 5.1 | 4.2 | 4.4 |
| 12 | PIB | 4.8 | 100 | 5.6 | 4.7 | 4.1 |
| 13 | PIB | 11.2 | 94.5 | 5.5 | 4.2 | 3.7 |
| 14 | SI | 0 | N.A. | 5.9 | 4.5 | 3.8 |
| 15 | SI | 0 | N.A. | 5.4 | 4.5 | 4.8 |
| 16 | PMA | 0 | N.A. | 5.5 | 4.8 | 4.7 |
| 17 | EPH | 1.6 | N.A. | 5.8 | 5.1 | 4.9 |
| 18 | SNR | 1.6 | 81 | 5.8 | 5.1 | 4.6 |
| 19 | EP | 3.7 | 94.5 | 5.9 | 4.7 | 4.5 |

Notes:
(1) Polymer/polymer solutions/diluents as identified in Table VIII. (Compar. Exs. 11-19) or in Example 8.
(2) H Factors calculated for polymer solutions.
(3) As described earlier.

From the data in Table IX, it is again seen that the use of high molecular weight polyisobutylene, in combination with a low aniline point hydrocarbon diluent in Example 8, provided an ammonium nitrate blasting agent having good fuel oil retention properties; the ANFO particles were found to suffer no additional fuel drainage after seven days and only slightly decreased in fuel retention after fourteen days.

In addition, the ANFO particles formed in Examples 11 through 19 showed increased stability of fuel retention over the period of time tested, relative to Control B.

COMPARATIVE EXAMPLE 20

In a separate run, 94.9 grams of white petrolatum (pure petroleum jelly, kinematic viscosity=11.74 cSt @100° C.; melting point=49° C.) is admixed with 5.0 grams of polyisobutylene (VISTANEX® L-80 PIB, Exxon Chemical Americas, visc. avg. MWt=750,000-1,050,000), and 0.1 gram of butylated hydroxy toluene (BHT) as antioxidant, by introducing the above to a glass mixing vessel provided with a stirrer. After vacuum stripping the vessel with $N_2$ for 30 minutes (to remove air to minimize polymer oxidative degradation), the mixture was stirred at 100° C. (vessel heated by oil bath) for 69 hours, to dissolve the polymer in the petrolatum. The kinematic viscosity of the resulting mixture was found to be 1,319.3 cSt @ 100° C., and the mixture was found to have a pour point of 56° C. The petrolatum PIB mixture was not free flowing at room temperature.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. Ammonium nitrate explosive compositions comprising a substantially dry, free-flowing mixture of particulate ammonium nitrate, carbonaceous fuel and at least one carbonaceous fuel soluble polymer selected for the group consisting of (1) polymers characterized by an h/c value of at least about 1, and (2) polymers characterized by an h/c value of less than 1 and by a viscosity average molecular weight of at least about 90,000.

2. The explosive compositions according to claim 1 wherein the particulate ammonium nitrate comprises high density ammonium nitrate prills having an untamped bulk density of from about 0.85 to 0.95 gm/cc.

3. The explosive compositions according to claim 2 wherein at least 95% of said high density ammonium nitrate prills comprise miniprills having a particle size of from about 0.4 to 2.4 millimeters.

4. The explosive compositions according to claim 1 wherein the carbonaceous fuel comprises fuel oil.

5. The explosive compositions according to claim 4 wherein the particulate ammonium nitrate comprises high density ammonium nitrate miniprills, having an untamped bulk density of from about 0.85 to 0.95 gm/cc.

6. The explosive compositions according to claim 1 wherein the explosives contain less than about 1 wt % water.

7. The explosive compositions according to claim 1 wherein the polymer comprises high molecular weight polyisobutylene, having an h/c value of at least about 1 and having a viscosity average molecular weight of from about 500,000 to 10,000,000.

8. The explosive compositions according to claim 7 wherein the polyisobutylene is characterized by an h/c value of at least 5.

9. The explosive compositions according to claim 1 wherein said explosive comprises from about 90 to 98 wt % ammonium nitrate, from about 0.01 to 1.0 wt % of said polymer and from about 2 to 9% of said carbonaceous fuel.

10. The explosive compositions according to claim 1 wherein said explosive composition additionally comprises from about 0.001 to 0.1 wt %, based on the weight of said ammonium nitrate, of at least one surfactant selected from the group consisting of $C_1$ to $C_{20}$ alkyl esters of $C_6$ to $C_{24}$ aliphatic carboxylic acids.

11. The explosive compositions according to claim 1 wherein said particulate ammonium nitrate is provided with a coating of a metallic salt of an aliphatic carboxylic acid having from 8 to 24 carbon atoms per molecule.

12. The explosive compositions according to claim 11 wherein the metallic salt comprises at least one member selected from the group consisting of calcium stearate, magnesium stearate, zinc stearate, and aluminum stearate.

13. The explosive compositions according to claim 11 wherein said metallic salt is employed in an amount of from about 0.001 to 1.0 wt % of said particulate ammonium nitrate.

14. The explosive compositions according to claim 13 wherein said carbonaceous fuel comprises fuel oil, said polymer comprises high molecular weight polyisobutylene having an h/c value of at least 5 to about 100 and wherein said explosive composition contains water in an amount of less than about 0.5 wt %.

15. The explosive compositions according to claim 14 wherein the particulate ammonium nitrate comprises high density ammonium nitrate miniprills.

16. The explosive compositions according to claim 14 wherein said explosives comprise from about 92 to 96 wt % ammonium nitrate, from about 0.03 to 0.15 wt % of said polyisobutylene, and from about 4 to 8 wt % of said carbonaceous fuel.

17. The explosive compositions according to claim 14 wherein said explosive composition additionally comprises from about 0.001 to 0.1 wt %, based on the weight of said ammonium nitrate, of at least one surfactant selected from the group consisting of $C_1$ to $C_{20}$ alkyl esters of $C_6$ to $C_{24}$ aliphatic carboxylic acids.

18. The explosive compositions according to claim 13 wherein said carbonaceous fuel comprises fuel oil; said polymer comprises at least one member selected from the group consisting of styrene-isoprene copolymers, polymethacrylates and polyisoprenes having an h/c value of less than 1 and having a viscosity average molecular weight of at least about 90,000; and said explosive composition contains water in an amount of less than about 0.5 wt %.

19. The explosive compositions according to claim 18 wherein the particulate ammonium nitrate comprises high density ammonium nitrate miniprills.

20. The explosive compositions according to claim 18 wherein said explosives comprise from about 92 to 96 wt % ammonium nitrate, from about 0.03 to 0.15 wt % of said polyisobutylene, and from about 4 to 8 wt % of said carbonaceous fuel.

21. The explosive compositions according to claim 18 wherein said explosive composition additionally comprises from about 0.001 to 0.1 wt %, based on the weight of said ammonium nitrate, of at least one surfactant selected from the group consisting of $C_1$ to $C_{20}$ alkyl esters of $C_6$ to $C_{24}$ aliphatic carboxylic acids.

22. A process for preparing ammonium nitrate-based explosives with improved storage properties which comprises contacting high density particulate ammonium nitrate in the substantial absence of water with a liquid mixture comprising a carbonaceous fuel and at least one polymer characterized by an h/c value of at least about 1 to form a dry, pourable ammonium nitrate explosive containing from about 90 to 98 wt % ammonium nitrate, from about 0.01 to 1.0 wt % of said polymer, and from about 2 to 9 wt % of said carbonaceous fuel.

23. The process according to claim 22 wherein said carbonaceous fuel is diesel fuel oil and wherein said liquid mixture has a kinematic viscosity of not greater than 300 c.S.t., at 25° C.

24. The process of claim 23 wherein said particulate ammonium nitrate comprises high density ammonium nitrate prills having a bulk density of from about 0.85 to 0.95 gm/cc.

25. The process according to claim 24 wherein said ammonium nitrate prills comprise miniprills and wherein said polymer comprises high molecular weight polyisobutylene having a viscosity average molecular weight of from about 500,000 to about 10,000,000 and being characterized by an h/c value of at least about 5 to about 100.

26. The process according to claim 25 wherein said polyisobutylene is employed in an amount sufficient to provide an ammonium nitrate explosive containing from about 0.03 to 0.15 wt % polyisobutylene, based on the total explosive.

27. The process according to claim 26 wherein said ammonium nitrate based explosive contains less than about 0.2 wt % water.

28. The process according to claim 24 wherein said high density particulate ammonium nitrate comprises high density ammonium nitrate prills which are provided with a coating of from about 0.001 to 0.1 wt %, based on the weight of said ammonium nitrate, of at least one finely divided metal, salt of an aliphatic carboxylic acids having from 8 to 24 carbon atoms.

29. A process for forming a dry, pourable ammonium nitrate-based explosive having improved storage properties which comprises (a) contacting high density ammonium nitrate prills with at least one finely divided metal salt of an aliphatic carboxylic acid having from 8 to 24 carbon atoms to form coated high density ammonium nitrate prills containing from about 0.001 to 1.0 wt % of said metallic salt as a coating thereon; and (b) contacting the said coated ammonium nitrate prills with a liquid mixture comprising a carbonaceous fuel and at least one hydrocarbon oil soluble polymer having an "h/c" value of at least about 1, to form said explosive, said polymer and carbonaceous fuel being employed in an amount sufficient to provide from about 90 to 98 wt % of said ammonium nitrate, from about 0.01 to 1.0 wt % of said polymer and from about 2 to 9 wt % of said carbonaceous fuel in said explosive, said carbonaceous fuel having an aniline point of less than about 95° C., and said liquid polymer/fuel mixture having an H factor of at least about 5, wherein said H factor is determined by the following expression $$H=h/c\times C'$$

wherein h/c is as defined above and C' is the weight percent concentration of said polymer in said polymer/fuel mixture.

30. The process according to claim 29 wherein said liquid mixture additionally comprises from about 0.001 to 0.1 wt %, based on the weight of said ammonium nitrate, of at least one surfactant selected from the group consisting of $C_1$ to $C_{20}$ alkyl esters of $C_6$ to $C_{24}$ aliphatic carboxylic acids.

31. A process for preparing ammonium nitrate-base explosives wiht improved storage properties which comprise contacting high density particulate ammonium nitrate in the substantial absence of water with a liquid mixture comprising a carbonaceous fuel and at least one polymer characterized by a h/c value of less than the number 1 and characterized by a viscosity average molecular weight of at least about 90,000 t form a dry, pourable ammonium nitrate explosive containing from about 90 to 98 wt % ammonium nitrate, from about 0.01 to 1.0 wt % of said polymer and from about 2 to 9 wt % of said carbonaceous fuel.

32. The process according to claim 31 wherein said carbonaceous fuel is diesel fuel oil.

33. The process of claim 31 wherein said particulate ammonium nitrate comprises high density ammonium nitrate prills having a bulk density of from about 0.85 to 0.95 gm/cc.

34. The process according to claim 33 wherein said ammonium nitrate prills comprise miniprills and wherein said polymer comprises high molecular weight polyisobutylene having a viscosity average molecular weight of from about 500,000 to about 10,000,000 and being characterized by an "h/c" value of at least about 5 to about 100.

35. The process according to claim 34 wherein said polyisobutylene is employed in an amount sufficient to provide an ammonium nitrate explosive containing from about 0.03 to 0.15 wt % polyisobutylene, based on the total explosive.

36. The process according to claim 35 wherein said ammonium nitrate based explosive contains less than about 0.2 wt % water.

37. The process according to claim 33 wherein said high density particulate ammonium nitrate comprises high density ammonium nitrate prills which are provided with a coating of from about 0.001 to 0.1 wt %, based on the weight of said ammonium nitrate, of at least one finely divided metal salt of an aliphatic carboxylic acid having from 8 to 24 carbon atoms.

* * * * *

UNITED STATES PATENT OFFICE

CERTIFICATE OF CORRECTION

Patent No. 4,736,683 Dated April 12, 1988

Inventor(s) H. E. Bachman, R. S. Totman

It is certified that error appears in the above-identified patent and that said Letters Patent are hereby corrected as shown below:

Claim 28, line 6, please delete the comma (",") in the phrase "metal, salt".

Claim 28, line 7, please delete "s" from the word "acids" so as to read "acid" after correction.

Signed and Sealed this

Twenty-eighth Day of February, 1989

*Attest:*

DONALD J. QUIGG

*Attesting Officer*

*Commissioner of Patents and Trademarks*